United States Patent [19]

Penny

[11] 3,939,651

[45] Feb. 24, 1976

[54] MOUNTING FOR ATTACHING A TUBULAR MEMBER IN CO-AXIAL REGISTRATION WITH AN APERTURE IN A WALL

[75] Inventor: Robert Noël Penny, Solihull, England

[73] Assignee: Caterpillar Tractor Co., Peoria, Ill.

[22] Filed: July 25, 1974

[21] Appl. No.: 491,801

[30] Foreign Application Priority Data

Aug. 8, 1973 United Kingdom.....37658/73

[52] U.S. Cl. ..... 60/39.32; 285/90; 285/209; 285/224

[51] Int. Cl.[2] ..... F02C 7/20

[58] Field of Search ..... 285/209, 210, 208, 90, 285/401, 376, 224, 223; 60/39.32, 39.31, 16 R

[56] References Cited

UNITED STATES PATENTS

| | | | |
|---|---|---|---|
| 2,200,874 | 5/1940 | Dann | 285/209 X |
| 2,643,581 | 6/1953 | Wehrenfenning | 285/376 X |
| 2,674,844 | 4/1954 | Boyd et al. | 60/39.32 X |
| 2,714,020 | 7/1955 | Yates | 285/223 X |
| 3,189,372 | 6/1965 | Johnson | 285/376 X |
| 3,670,497 | 6/1972 | Sheldon | 60/39.32 |
| 3,704,075 | 11/1972 | Karstensen | 60/39.16 R |
| 3,727,955 | 4/1973 | Carter | 285/233 |
| 3,823,553 | 7/1974 | Smith | 60/39.31 X |

FOREIGN PATENTS OR APPLICATIONS

| | | | |
|---|---|---|---|
| 1,170,953 | 11/1969 | United Kingdom | 285/224 |

*Primary Examiner*—Thomas F. Callaghan
*Attorney, Agent, or Firm*—Gifford, Chandler & Sheridan

[57] ABSTRACT

A mounting particularly for attaching a tubular nozzle shroud member of a gas turbine in co-axial registration with an aperture in a supporting wall comprising a spigot at the end of the tubular member to be fitted into the aperture, the spigot being of complementary shape to the aperture and having radially outwardly extending lugs spaced apart around its periphery, and the wall having a corresponding number of notches spaced apart around the periphery of the aperture, the lugs being aligned with the notches and inserted through the latter by axial movement of the tubular member and retained, in the manner of a bayonet-type of coupling, by the portions of the wall between the notches when the tubular member has been partly turned about its longitudinal axis, the tubular member also having a flange spaced axially from the lugs and sealingly engaged with the wall when the lugs are located behind said wall portions, to hold the tubular member from axial movement with respect to the wall, the wall and the flange each having a pin-receiving opening therein, the openings being so positioned in the wall and the flange that when the tubular member has been turned to the retained position the openings are in registration one with the other and receive a removable locking pin to prevent turning of the tubular member from the retained position, one of the openings being elongate in a direction radially of the longitudinal axis of the tubular member to permit limited relative movement between the tubular member and the wall.

7 Claims, 3 Drawing Figures

MOUNTING FOR ATTACHING A TUBULAR MEMBER IN CO-AXIAL REGISTRATION WITH AN APERTURE IN A WALL

BACKGROUND

FIELD OF THE INVENTION

The invention relates to a mounting for attaching a tubular member in co-axial registration with an aperture in a wall or other supporting structure and is particularly concerned with mounting a turbine nozzle shroud in an aperture in a wall of a housing of a gas turbine engine.

DESCRIPTION

One object of the invention is to provide a mounting which enables the tubular member to be quickly secured to and detached from the wall and another object is to enable substantially co-axial registration to be maintained with minimum induced stresses and distortion despite differential movement between the tubular member and the wall due to temperature variation.

SUMMARY OF THE INVENTION

According to the invention, a mounting for attaching a tubular member in co-axial registration with an aperture in a wall or other supporting structure comprises a spigot at the end of the tubular member to be fitted into the aperture, the spigot being of complementary shape to the aperture and having a plurality of radially outwardly extending lugs spaced apart around its periphery, and the wall having a corresponding number of notches spaced apart around the periphery of the aperture, whereby the lugs when aligned with the notches are insertable through the latter by axial movement of the tubular member and are retained, in the manner of a bayonet-type of coupling, by the portions of the wall between the notches when the tubular member has been partly turned about its longitudinal axis, the tubular member also having a flange spaced axially from the lugs and sealingly engageable with the wall when the lugs are located behind said wall portions, whereby the lugs and the flange together hold the tubular member from axial movement with respect to the wall, the wall and the flange each having a pin-receiving opening therein, said openings being so positioned in the wall and the flange respectively that when the tubular member has been turned to said retained position the openings are in registration one with the other and receive a removable locking pin to prevent turning of the tubular member from said retained position, one of the openings being elongate in a direction radially of the longitudinal axis of the tubular member to permit limited relative movement between the tubular member and the wall.

The flange or the wall may carry a resilient peripheral seal which engages between the flange and the wall to effect a seal therebetween, when the tubular member is retained from axial movement in the aperture in the wall by the lugs and the flange, while permitting said limited relative movement between the tubular member and the wall.

The aforesaid openings for receiving the locking pin may comprise a screw-threaded hole in the wall or the flange in which a screw-thread on the locking pin is engageable and an elongate radial slot in the flange or the wall respectively into which the locking pin extends. There may be one removable locking pin engageable in one or in a selected one of a plurality of pairs of circumferentially-spaced registrable holes and slots or there may be a plurality of removable locking pins each engageable in a respective pair of a plurality of pairs of circumferentially spaced, registrable holes and slots.

The mounting in accordance with this invention is particularly intended, as aforesaid, to be used for supporting a turbine nozzle shroud member in a gas turbine engine and therefore, according to another aspect of the invention, a gas turbine engine includes a nozzle shroud member, being the aforesaid tubular member, having at one end thereof a spigot which is to be fitted into an aperture in a transverse wall in a housing or other stationary structure of the engine, the transverse wall being the aforesaid wall, and a mounting for attaching the tubular member in co-axial registration with the aperture in the wall as set out in any one of the three immediately preceding paragraphs.

The nozzle shroud member may conveniently be connected at each end thereof to adjacent tubular wall portions defining the working fluid passage through the engine by couplings permitting sliding of the nozzle shroud member relatively to said tubular wall portions in directions parallel to the longitudinal axis of the engine. The couplings may also permit tipping of the nozzle shroud member relatively to the adjacent tubular wall portions. Thus the latter couplings, the resilient seal, where provided, and the locking pin or pins permit the nozzle shroud member to remain in substantial co-axial registration with the aperture in the transverse wall with minimum induced stress and distortion despite expansion of the shroud member under operating temperature.

BRIEF DESCRIPTION OF THE DRAWING

By way of example, a mounting, in accordance with the invention, for a turbine nozzle shroud member in a gas turbine engine is now described with reference to the accompanying drawings, in which.

DESCRIPTION OF THE PREFERRED EMBODIMENT

Figure 1:
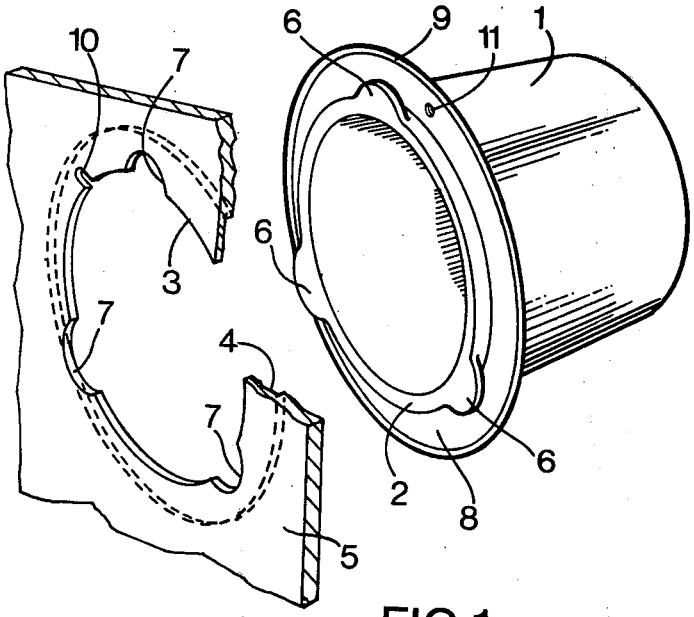
FIG. 1 is an exploded diagrammatic perspective view of the shroud and a supporting wall therefor.
Figure 3:
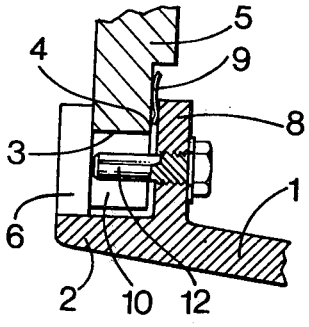
FIG. 3 is an axial section through a part of the gas turbine engine showing a compressor-driving turbine and an independent power turbine having variable angle nozzle guide vanes and the nozzle shroud member and mounting in accordance with this invention.

Referring to FIGS. 1 and 3, the nozzle shroud member is shown at 1 and has at one end thereof a spigot 2 having an external cylindrical surface except for three circumferentially spaced lugs, as hereinafter mentioned, and which is insertable in a circular aperture 3 in a sealing face 4 machined in a transverse wall 5 of the housing of the gas turbine engine in which the shroud 1 is to be fitted. The spigot 2 has the three circumferentially spaced lugs 6 extending radially outwardly therefrom. The lugs 6 fit freely into respective complementary notches 7 formed in the sealing face 4 on axial insertion of the spigot into the aperture 3. The shroud 1 is then turned to bring the lugs 2 behind portions of the sealing face 4 which are un-notched and thus the spigot is retained from axial withdrawal, in an equivalent manner to that of a bayonet-type of coupling. The shroud 1 has an externally extending flange 8 spaced from the lugs 6 by a distance such that when the shroud has been secured in the wall 5 by the lugs 6 engaging behind the sealing face 4, the flange 8 will be spaced slightly in front of the sealing face 4 to limit the axial movement of the shroud 1 to the left, as viewed in FIG. 2. The flange 8 carries a curtain seal formed by an annular spring strip 9 welded to the flange and sealingly and resiliently engaging the sealing face 4. Thus when the lugs 6 are engaged behind the sealing face 4, the spring strip 9 sealingly engages the sealing face 4; but it does permit relative sliding movement between the flange 8 and the sealing face 4.

Intermediate two of the notches 7 in the aperture 3, the wall defining the latter is formed with a radial guide slot 10. The flange 8 is provided with a screw-threaded hole 11 in a position in which the hole 11 will be registrable with the slot 10 after the lugs 6 have been positioned behind the sealing face 4. A locating screw or pin 12 having a screw-thread on at least its inner end is screwed into the hole 11 to extend freely in the slot 10 (see FIG. 2). The pin 12 serves to prevent the turning of the shroud 1 to bring the lugs 6 into registration with the notches 7 and thus prevent unintentional uncoupling of the shroud 1 from the wall 5. It also permits expansion or contraction of the shroud 1 relatively to the wall 5 on temperature change and ensures by sliding in the slot 11 that the shroud will be maintained substantially co-axial with the aperture 3 and hence with the turbine axis. The spring strip 9 slides on the sealing face 4 during expansion or contraction of the shroud 1 and thus maintains the seal between the shroud 1 and the wall 5.

When the shroud 1 is to be removed, the pin 12 is removed from its hole 11 and the slot 10, thereby enabling the shroud 1 to be readily uncoupled by turning it to bring the lugs 6 into alignment with the notches 7.

Although the sealing strip 9 is shown carried by the flange 8, it could be carried by the sealing face 4. Alternatively the sealing strip 9 may be freely positioned between the flange 8 and the sealing face 4 and be carried by neither of those parts.

Although only one pin 12 is insertable into one registrable hole 11 and slot 10, a plurality of pins 12 may be provided, each to be engaged in one of a plurality of pairs of registrable holes 11 and slots 10. For example there may be three equally spaced pairs of holes 11 and slots 10 and three pins 12. Alternatively one pin 12 may be engageable in a selected pair of a plurality of registrable holes and slots. Instead of the radial slot or slots 10, the latter may be elongated holes.

The lugs 6 and the notches 7 may be made of any convenient shape and not only of the shape illustrated in FIG. 1.

Although the mounting provided by this invention has been applied to a turbine shroud it may be used in other gas turbine engine sub-assemblies and in other engineering applications where a tubular member is to be readily coupled or uncoupled and when coupled is to be permitted to expand or contract relatively to a wall or other structure with which a seal is to be maintained.

Figure 2:
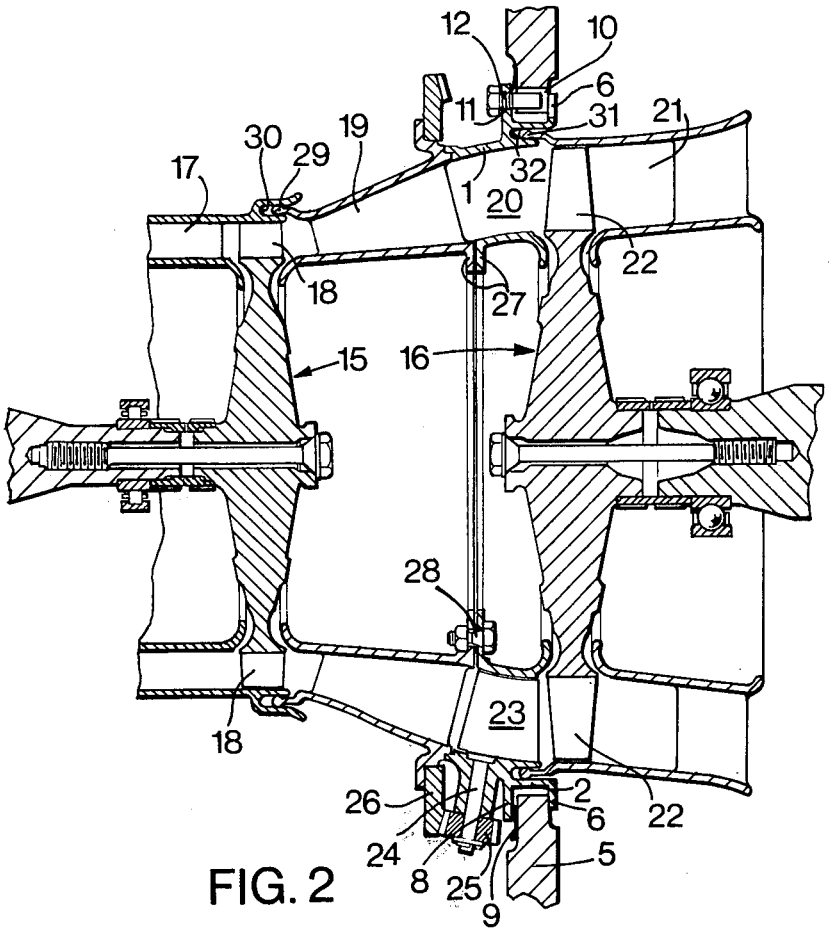
FIG. 2 is an axial cross-section through a portion of the shroud and wall when assembled.

Reference is now made to FIG. 2 in which the compressor-driving turbine is indicated by arrow 15 and the power output turbine is indicated by arrow 16. An annular flow-path for working fluid is defined by inner and outer annular wall portions of which portion 17 leads working fluid to and through the blades 18 of the compressor-driving turbine 15; portion 19 leads working fluid from the compressor-driving turbine 15 to a portion 20 incorporating the nozzle shroud member 1, and portion 21 leads working fluid through and from the rotor blades 22 of the power turbine 16.

The annular wall portion 20 contains variable angle nozzle blades 23 (one only being shown) each mounted on a spindle 24 and movable angularly by a pinion 25 carried by the nozzle shroud member 1. The nozzle blade pinions 25 engage a toothed ring 26 carried by the wall portion 19. The nozzle shroud member 1 has an integral flange 8 and lugs 6, as in FIGS. 1 and 3.

The spigot 2 is inserted into the aperture 3 in a wall 5, as shown in FIGS. 1 and 2, the wall 5 being a transverse wall of the housing or other stationary structure of the engine. As shown in FIGS. 1 and 2, the flange 8 carries an annular spring strip 9 forming a seal. Also the flange 8 has a screwed hole 11 therein which receives a locking screw or pin 12 extending into a radial slot 10 in the wall 5, as shown in FIGS. 1 and 2, to prevent uncoupling of the nozzle shroud member 1 (i.e., the whole annular wall portion 20 and the nozzle vane assembly) until the pin 12 has been removed. The wall portions 19 and 20 have abutting flanges 27 bolted together at 28.

The left-hand end of the outer part of the wall portion 19 is rounded at 29 and is slidable in the axial direction in annular socket 30 on the adjacent end of the outer part of the wall portion 17. Similarly the left-hand end of the outer part of the wall portion 21 is rounded at 31 and is slidable in the axial direction in an annular socket 32 formed on the shroud member 1. The slidable joints 29, 30 and 31, 32 permit the assembled wall portions 19 and 20 and the wall portions 17 and 21 to expand relatively to each other in the axial direction. The rounded ends 29 and 31 also permit some universal tipping of the assembled annular wall portions relatively to the wall portions 17 and 21. These movements are also permitted by the spring strip 9. Radial expansion of the nozzle shroud member and hence of the assembled annular wall portions 19 and 20 is permitted by the pin 12 sliding in the radial slot 10.

The construction illustrated in FIG. 3 therefore not only provides a quick way of mounting and removing the nozzle blade assembly; but also allows expansion without substantial axial misalignment of the shroud member 1 with respect to the turbine axis, although some axial misalignment of the adjacent annular wall portions is permitted by virtue of the rounded ends 29 and 31. There is therefore minimum induced stress and distortion of the nozzle blade assembly.

I claim:

1. A gas turbine engine including a turbine, ducting positioned upstream and downstream of said turbine and defining a working fluid passage through said turbine, the ducting including a tubular nozzle shroud member, supporting structure for said shroud member, said shroud member having at one end thereof a spigot which is to be fitted into an aperture in said supporting structure, and a mounting supporting the tubular nozzle shroud member in co-axial registration with the aperture in said supporting structure, said mounting comprising said spigot, which is of complementary shape to said aperture, a plurality of radially outwardly extending lugs spaced apart around the periphery of said spigot, and the supporting structure having a corresponding number of notches spaced apart around the periphery of the aperture, said lugs when aligned with the notches being insertable through said notches by axial movement of said tubular member and retained, in the manner of a bayonet-type of coupling, by portions of said supporting structure between said notches when said tubular member has been partly turned abouts its longitudinal axis, said tubular member also having a flange spaced axially from said lugs and sealingly engageable with said supporting structure when said lugs are located behind said portions between said notches, said lugs and said flange together holding said tubular member from axial movement with respect to said supporting structure, said supporting structure and said flange each having a pin-receiving opening therein, said openings being so positioned in said supporting structure and said flange respectively that when said tubular member has been turned to said retained position said openings are in registration one with the other, a removable locking pin insertable in said registered openings to prevent turning of said tubular member from said retained position, one of said openings being elongate in a direction radially of the longitudinal axis of said tubular member to permit limited relative movement between said tubular member and said supporting structure.

2. A gas turbine engine as claimed in claim 1 in which said ducting includes tubular wall portions positioned upstream and downstream of said tubular nozzle shroud member and couplings between said tubular wall portions and said tubular nozzle shroud member permitting sliding of said tubular nozzle shroud member relatively to said tubular wall portions in directions parallel to the longitudinal axis of said engine.

3. A gas turbine engine as claimed in claim 2 in which said couplings also permit tipping of said tubular nozzle shroud member relatively to the adjacent tubular wall portions.

4. A gas turbine engine as claimed in claim 1 in which a resilient peripheral seal engages between said flange and said supporting structure to effect a seal therebetween, when said tubular member is retained from axial movement in the aperture in the wall by said lugs and said flange, said seal permitting said limited relative movement between said tubular member and said supporting structure.

5. A gas turbine engine as claimed in claim 1 in which said openings for receiving said locking pin comprise a screw-threaded hole in one of said supporting structure and said flange in which a screw-thread on said locking pin is engaged and an elongate radial slot in the other of said supporting structure and said flange into which said locking pin extends.

6. A gas turbine engine as claimed in claim 5 in which one said locking pin is engaged in any one of a plurality of pairs of circumferentially spaced, registrable holes and slots.

7. A gas turbine engine as claimed in claim 5 in which each of a plurality of said locking pins is engageable in a respective pair of a plurality of pairs of circumferentially spaced registrable holes and slots.

* * * * *